United States Patent [19]

Kieffer et al.

[11] Patent Number: 4,624,602

[45] Date of Patent: Nov. 25, 1986

[54] PARKING LOT LINE STRIPER

[75] Inventors: Joseph W. Kieffer, Plymouth; Norman A. Cyphers, Rogers, both of Minn.

[73] Assignee: Wagner Spray Tech Corporation, Minneapolis, Minn.

[21] Appl. No.: 664,988

[22] Filed: Oct. 26, 1984

[51] Int. Cl.[4] ..... E01C 23/16

[52] U.S. Cl. ..... 404/94; 427/137; 239/150; 239/172; 239/176; 118/305

[58] Field of Search ..... 404/93, 94; 239/146, 239/150, 172, 176; 118/305; 427/136, 137; 16/35 R; 280/79.1 R

[56] References Cited

U.S. PATENT DOCUMENTS

| | | | |
|---|---|---|---|
| 1,999,563 | 4/1935 | Glasgow | 239/150 X |
| 3,148,833 | 9/1964 | Wilson et al. | 239/150 X |
| 3,162,369 | 12/1964 | Mitchell | 239/150 |
| 3,352,283 | 11/1967 | Maus | 404/94 X |
| 3,687,371 | 8/1972 | Swager | 118/305 X |
| 4,414,702 | 11/1983 | Neumann | 16/35 R |

FOREIGN PATENT DOCUMENTS

| | | | |
|---|---|---|---|
| 638780 | 3/1962 | Canada | 118/305 |

*Primary Examiner*—Stephen J. Novosad
*Assistant Examiner*—John F. Letchford
*Attorney, Agent, or Firm*—Hill, Van Santen, Steadman & Simpson

[57] ABSTRACT

A pavement line striper is provided which has a pair of spaced apart front wheels and a pivotable rear steering wheel. Paint spray guns may be mounted closely adjacent to one or both of the front wheels. One of the front wheels is laterally movable to allow for the painting of parallel stripes of selectively variable spacing. Two guns may be mounted on one side for vertical and horizontal spraying of a curb in one pass or for closely spaced parallel lines. The guns remain closely adjacent the wheels to minimize uneven thickness of the lines when spraying on uneven terrain. The rear wheel is lockable against pivoting movement and indicia markings are provided to permit selection of a radius for curved lines.

14 Claims, 6 Drawing Figures

PARKING LOT LINE STRIPER

BACKGROUND OF THE INVENTION

1. Field of the Invention

This invention relates to a paint spraying device and more particularly to a device for spraying lines in a parking lot or the like.

2. Description of the Prior Art

Devices exist for painting lines on pavement in parking lots and other locations in which the line is sprayed onto the pavement by a paint spraying gun. The prior devices have serious drawbacks and limitations which include: (a) the inability to spray both the top and side of curbs during a single pass, (b) controlling the width of the stripe when a second gun is mounted at the end of an axle extension because the extension moves toward and away from the pavement as the frame tilts due to surface bumps acting on any one of the wheels, (c) the inability to control the radius in a curved striped spraying procedure, (d) a narrow range of parallel striping which can be applied in a single pass, and (e) inflexibility of the line striper device which prevents the device from being used as a conventional paint sprayer without additional attachments.

SUMMARY OF THE INVENTION

The present invention provides for a device which overcomes the limitations described above by providing a three wheeled paint spraying device in which two spray guns can be selectively mounted on one side of the device allowing the operator to position one spray gun nozzle horizontal to the curb and another spray nozzle vertical to the curb. In this manner, both surfaces are painted simultaneously as paint is distributed downward and at a right angle at the same time. Thus, an entire curb can be sprayed in one pass.

Also, the spray guns are mounted to bushings on the wheel axles closely adjacent the wheels to prevent variations in stripe width on uneven surfaces. One of the wheels is mounted on an extendable axle such that two widely spaced stripes can be sprayed simultaneously while still having each spray head mounted closely adjacent a wheel.

The device has a single rear wheel which pivots for steering and this rear wheel can be locked in any rotated position to provide a fixed and accurate radius for striping. A pointer and dial are associated with the pivoting rear wheel to provide an accurate gauge in selecting a desired stripe radius.

Both spray guns can be mounted on one side of the device spraying downwardly or on opposite sides of the device to provide a range of spaced parallel stripes from overlapping to the width of the extended wheel base.

Another feature and advantage of the disclosed device is that the spray guns are not dedicated to the device, but are selectively removable to permit their use in a normal paint spraying mode such as spray painting a wall. Thus the device has versatility beyond being just a line striper.

Other features and advantages of the invention will be readily apparent from the following description of certain preferred embodiments.

DESCRIPTION OF THE PREFERRED EMBODIMENTS

Figure 1:
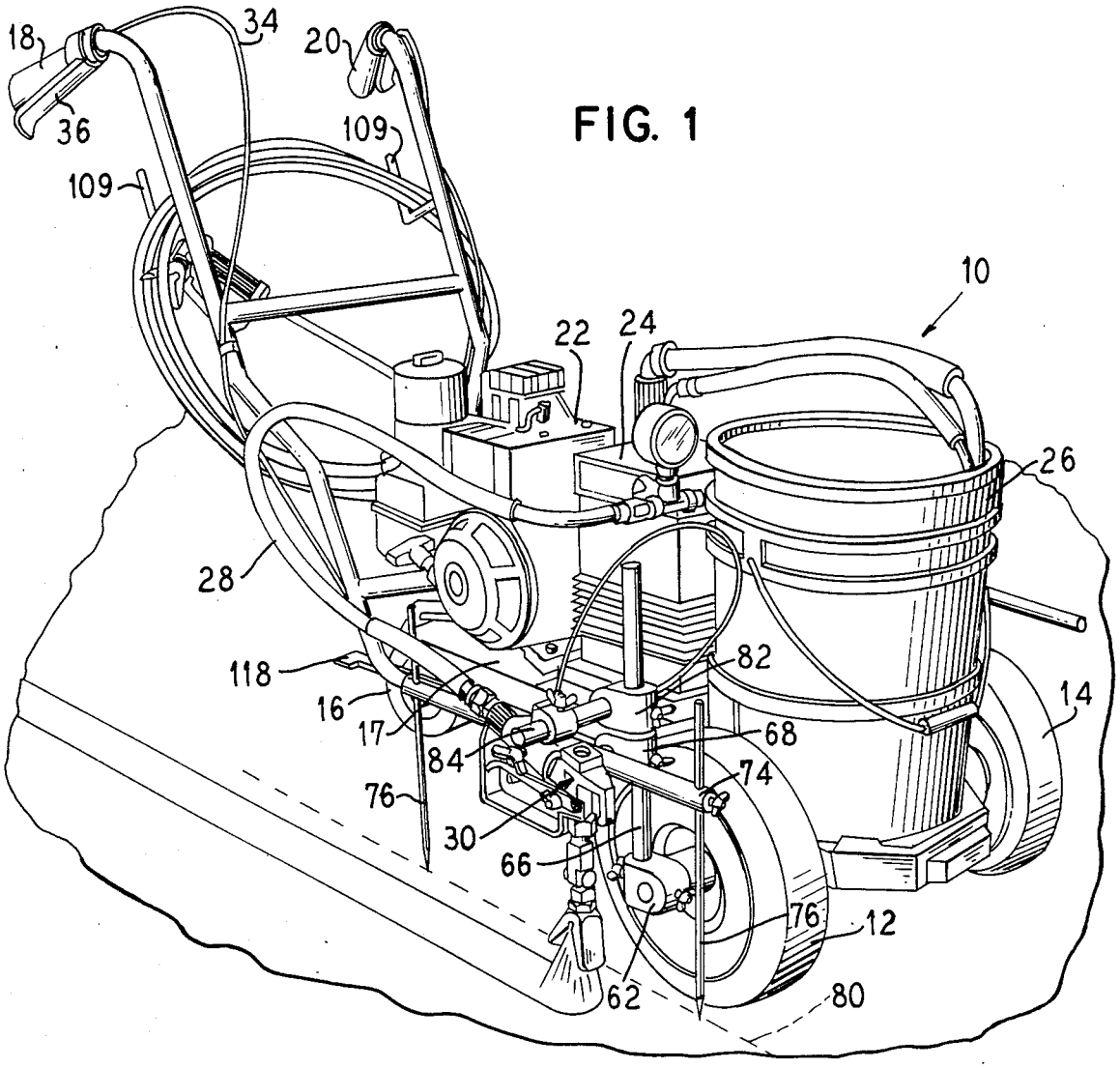
FIG. 1 is a perspective view of a line striping device emboding the priciples of the present invention.

In FIG. 1 there is shown a device generally at 10 for spray painting one or more stripes on a pavement. The device 10 has two spaced front wheels 12, 14 and a single pivotable rear wheel 16 which supports a frame 17 of the device for rolling movement over the pavement. A pair of manually graspable handles 18, 20 are connected to the frame 17 for pushing and steering the device.

A gasoline engine 22 drives an airless paint spraying pump 24, such as that disclosed in U.S. Pat. No. Re. 29,055, to pressurize paint drawn from a bucket or reservoir 26. The paint is directed by a tube or conduit 28 to a spray gun 30, such as the type disclosed in U.S. Pat. No. 3,515,355 or 3,743,188, for selective spraying on the pavement.

Figures 3, 4:
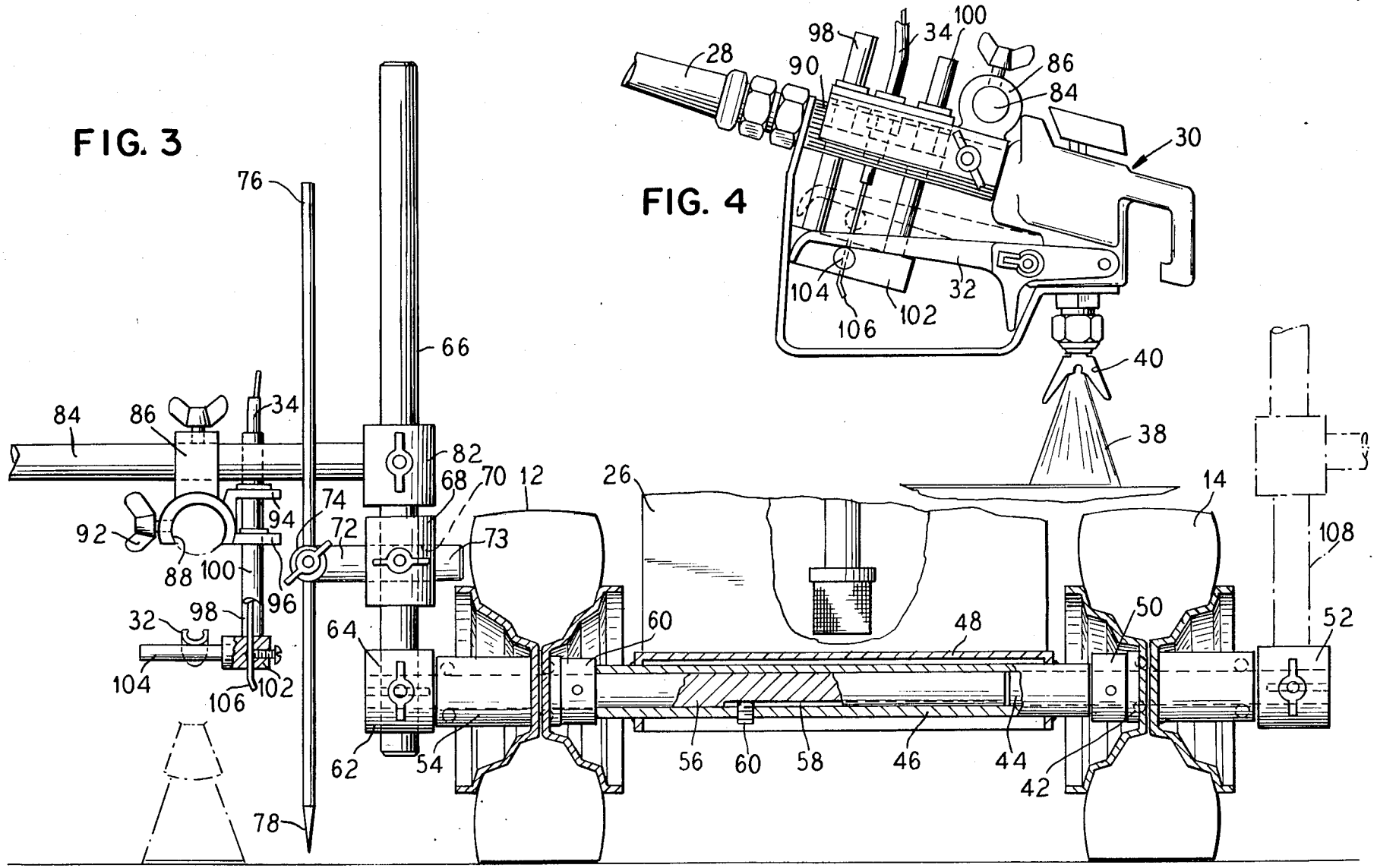
FIG. 3 is a partial sectional view through the front axle of the device.
FIG. 4 is a side elevational view of a paint spray gun.

As best shown in FIGS. 3 and 4, the spray gun 30 has a trigger 32 which is activated by use of a Bowden cable 34 connected to a pivotable lever 36 mounted on the handle 18. By squeezing the lever 36 against the handle 18, the trigger 32 on the spray gun 30 is activated causing a valve within the spray gun to open resulting in a cone 38 of paint being sprayed from a nozzle 40 of the spray gun when pressurized paint is in the tube 28.

As best shown in FIG. 3, the front wheel 14 is mounted by means of a bearing hub 42 on a short non-rotating axle 44 telescopically received in an axle housing 46 which is in turn secured to a frame member 48. A bushing 50 is mounted on the axle 44 between the bearing 42 and the axle housing 46 providing an inward stop or shoulder for the wheel 14. An outer bushing 52 is mounted on an outside end of the axle 44 to provide an outward stop for the wheel bearing 42. Thus, the wheel is free to rotate on the fixed axle 44.

The second front wheel 12 is mounted by means of a bearing 54 on a relatively long axle 56 which is longitudinally slidable within the axle housing 46. A recessed keyway 58 is provided on the axle 56 and a set screw 60 is engageable with the keyway 58 to selectively lock the axle 56 to the axle housing 46. An inside bushing 60 and an outside bushing 62 are provided on either side of the wheel bearing 54 to provide lateral stops for the wheel as described above.

The outer bushings 52, 62 have a second function in addition to acting as lateral wheel stops. Referring to bushing 62, it is shown that there is a vertical cylindrical passage 64 therethrough for receiving a post 66. Selectively movably mounted on the post is a first mounting bracket 68 which has a horizontal passage 70 therethrough for receiving a mounting arm 72. The mounting arm 72 is in the shape of a T with a base portion 73 slidably received in the bracket 68 and the cross-bar portion 74 extending forwardly and rearwardly perpendicular to the post 66 and having apertures therethrough for receiving a pair of alignment rods 76 which can be moved vertically and locked in a selected position. The alignment rods 76 have a pointed lower end 78 which can be positioned closely adjacent to the surface on which the wheels 12, 14 ride to provide a visual means of guiding the device 10 along a predetermined marked path 80.

A second mounting bracket 82 is carried on the post 66 which has a mounting arm 84 slidably received therein. A mounting bracket 86 is movably secured to the arm 84. The bracket 86 has an adjustable opening 88 therein for receiving a grip portion 90 of the paint spray head 30. A set screw 92 is provided to selectively grip the handle 90.

FIGS. 3 and 4 also show the attachment of the Bowden cable 34 which is used to operate the trigger 32. The bracket 86 has a pair of outwardly projecting ears 94, 96, each having a pair of aligned apertures therethrough for receiving guide rods 98, 100. The guide rods 98, 100 are connected at their bottom ends by a cross-bar 102 which has a forwardly projecting finger 104 positionable below the trigger 32. An end 106 of the Bowden cable 34 is secured to the cross-bar 102. Thus, when the cable is pulled upwardly by activation of the handle levers 36, the trigger 32 is lifted as shown in phantom in FIG. 4 to open the spray head valve as described above.

As FIG. 3 shows in phantom, a second post 108 can be mounted in the mounting bushing 52 so that a second spray gun can be mounted on the opposite side of the device thus providing two independently controllable spray heads to allow for simultaneous parallel striping. To change the spacing between the two spray guns mounted on opposite sides of the device, the set screw 60 is loosened and the axle 56 is moved relative to the axle housing 46 to provide a lesser or greater distance between the spray guns. FIG. 3 shows an arrangement for minimum spacing between the two opposite sided guns. When the guns are to be spaced farther apart, not only do the guns move outwardly but also the wheel 12 moves outwardly and thus the gun is maintained in close proximity to the wheel to avoid uneven width of the stripes being painted on uneven terrain. This is in contrast to prior devices which move the gun outwardly relative to the wheel.

As shown in FIG. 1, if the second spray gun is not being used, the spray gun can be detached from the bracket 86 and its associated tubing can be stored on a portion of the frame 17 leading up to the handles 18, 20. A plurality of L-shaped brackets 109 are provided around which the excess tubing can be wrapped.

Figure 5:
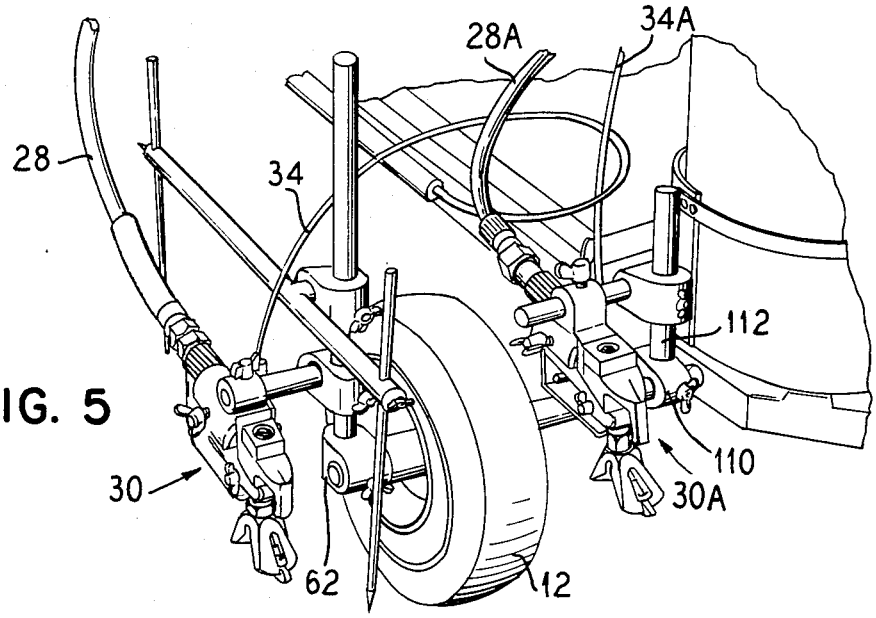
FIG. 5 is a partial perspective view showing an alternate mounting arrangement for the spray guns for painting parallel stripes.

An alternate mounting arrangement is shown in FIG. 5 which shows the spray gun 30 mounted outboard of the wheel 12 as described above, and also shows a second spray gun **30*a* mounted inboard of the wheel 12 on the same side of the device. In this configuration, a mounting bracket 110 is mounted on the axle 56 similarly to bracket 62 and it carries a vertical mounting post 112. The second spray gun 30*a* is mounted vertically identically to the mounting described above with respect to the spray gun 30. A second Bowden cable 34*a* and second paint supply line 28*a* are connected to the second spray gun 30*a* to operate the gun as described above. With this mounting configuration, parallel stripes can be simultaneously applied to the pavement with the width between the stripes being less than the wheel base of the device. Again, the width between the two guns 30, 30*a* can be adjusted by adjusting the position of the axle 56 within the axle housing 46**. Thus, it is seen that the device is capable of applying parallel stripes throughout a wide range of stripe spacing.

Figure 6:
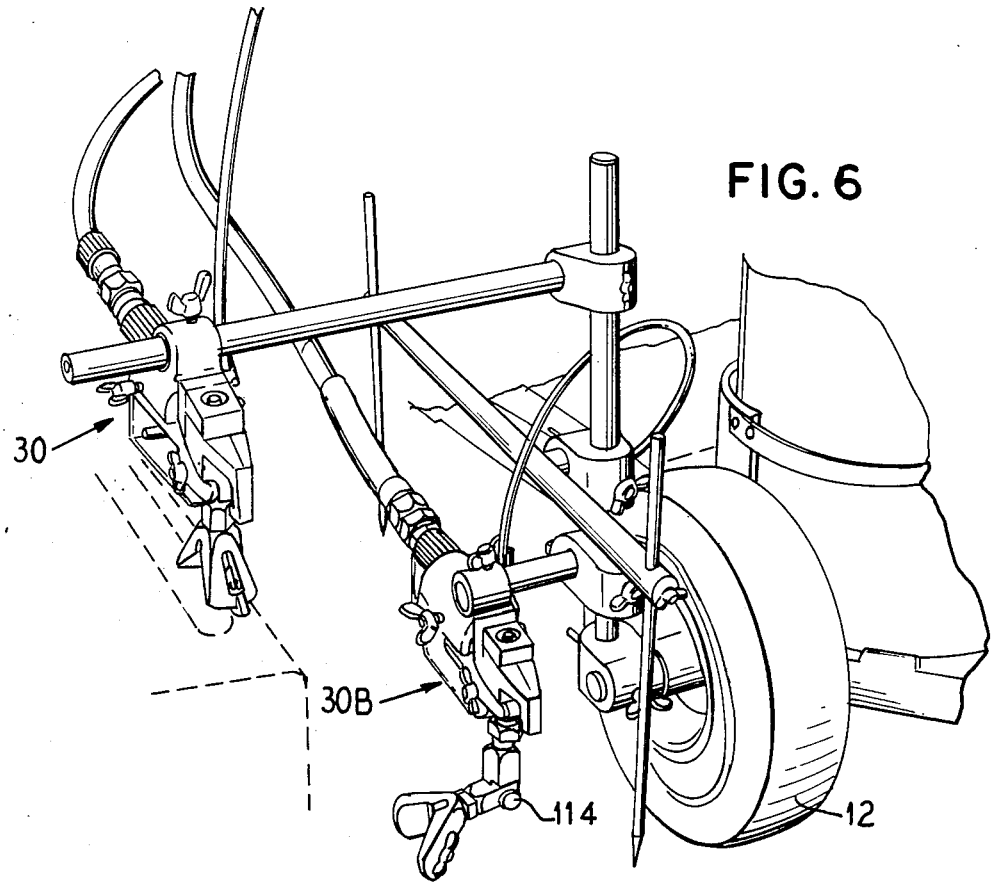
FIG. 6 is a partial perspective view showing an alternate mounting arrangement for the spray guns for painting curbs.

In FIG. 6 there is shown a second alternate mounting arrangement with two spray guns mounted outboard of the wheel 12. The first spray gun 30 is mounted as described above. The second spray gun **30*b* has a nozzle assembly 114** which can be pivoted to 90° such that the gun sprays parallel with the pavement surface. Thus, both the top horizontal surface and the side vertical surface of a curb can be painted simultaneously. This provides a significant advantage over presently available line stripers.

Although not shown in the drawings, it can be readily seen that two spray guns can be mounted on a single mounting arm outboard of the wheel 12 to provide parallel stripes so close as to be overlaping or selectively farther apart up to a distance equal to that when one gun is mounted inboard and one gun mounted outboard of the wheel 12. Thus, the dual outboard mounting arrangement further increases the range of parallel striping capabilities.

As mentioned above, the spray gun 30 can be removed from its mounting bracket 86 and can be used in a hand held configuration for conventional spray painting. The second spray gun can also be used independently in a hand held mode thus greatly increasing the versatility of the device.

Figure 2:
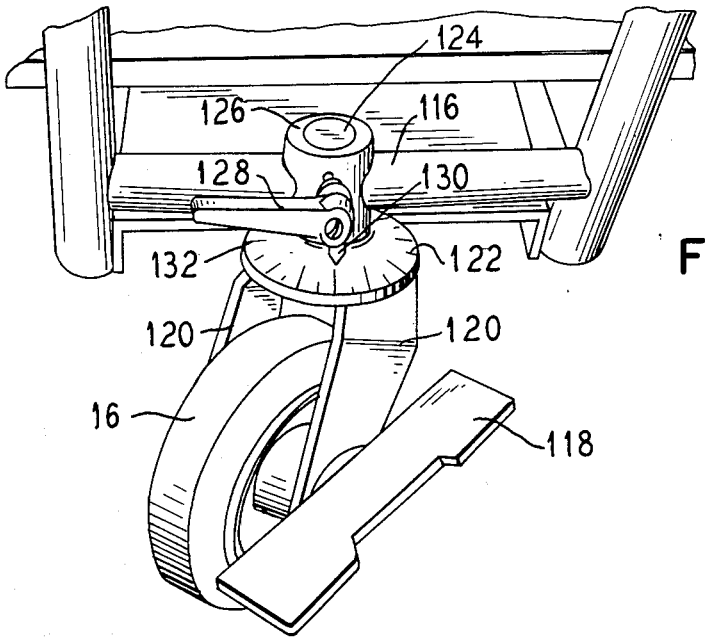
FIG. 2 is a perspective view of the rear wheel.

As shown in better detail in FIG. 2, the rear wheel 16 is pivotably mounted to a frame member 116 of the device to allow for steering of the device. A foot operated brake pedal 118 is provided to lock the wheel 16 against rotation to prevent unwanted movement of the device.

The wheel 16 is mounted on a pair of upstanding brackets 120 which are connected at their top by a plate 122 which has a vertical post 124 extending upwardly therefrom. The frame member 116 has a vertical cylindrical portion 126 for receiving the post 124. A set screw-like lock mechanism 128 is provided to extend through the vertical cylinder portion 126 to engage the post 124 to prevent rotation of the post relative to the cylinder 126. Thus, the wheel 16 can be selectively locked in a specific pivotal placement.

Extending outwardly from the cylindrical portion 126 is a pointer 130 and on the top plate 122 are a plurality of indicia markings 132 which allow the user to select a specific radius for applying a stripe based on a specific location of a paint spray head. Thus, for straight line striping, the pointer can be set at 0 and the locking mechanism 128 tightened so that the device will roll in a straight line thus applying a straight stripe. When a curve is desired, the appropriate radius is selected by pivoting the wheel 16 so that the pointer 130 points to the selected radius shown on the indicia markings 132. Both right and left radii can be marked as well as dual sets of markings to allow for different lateral positions of the spray gun. Thus, it is seen that there is provided a precise ability to control the radius of the stripe being painted.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. A device for spraying lines on a pavement comprising:

a frame member;

a paint reservoir mounted on said frame for holding an supply of paint;

means mounted on said frame for pressurizing said paint;

a plurality of wheels mounted on said frame to permit said frame to be rolled on said pavement;

means for mounting two of said wheels on a common axis;

a pluraity of spray guns connected by conduit means to said pressurized paint;

means for removably mounting said spray guns closely adjacent at least one of said wheels and selectively positionable along the vertical plane of said common wheel axis;.

means for selectively and independently manually activating said spray guns for applying paint to said pavement;

at least one of said spray guns being removably mounted to the mounting means of said wheels;

means for laterally extending one of said wheels on said common axis, and said one of said spray guns, relative to said frame;

whereby, said one of said spray guns can be moved laterally relative to said frame without changing its proximity to its associated wheel.

2. The device of claim 1 wherein said wheels comprise two front spaced apart fixed wheels on said common axis and a single pivotable steerable rear wheel, said spray gun mounting means being adjacent at least one of said front wheels.

3. The device of claim 2 wherein a spray gun is mounted outboard of each of said two front wheels.

4. The device of claim 2 wherein a first spray gun is mounted inboard of one of said front wheels and a second spray gun is mounted outboard of said front wheel.

5. The device of claim 2 wherein said rear wheel is lockable against pivoting.

6. The device of claim 2 wherein a pointer and dial are provided at said rear wheel to permit the selection of a desired turning radius by appropriate pivoting of said rear wheel.

7. The device of claim 1 wherein two spray guns are mounted outboard of said one of said wheels relative to said frame, each gun being mounted along the vertical plane of said common wheel axis.

8. The device of claim 7 wherein one of said spray guns has a nozzle directing spray downwardly and said second spray gun has a nozzle directing spray horizontally outwardly whereby a top and side surface of a curb can be sprayed simultaneously.

9. In a device for spraying lines on a pavement which includes a wheeled frame having means for mounting a spaced apart pair of front wheels on a common axis, a pivotable rear steering wheel and carrying a reservoir of paint, means for pressurizing the paint, and at least two spray guns for applying the paint on the pavement, the improvement comprising:

mounting means for adjustably securing each of said spray guns adjacent at least one of said front wheels and selectively positionable along the vertical plane of said common axis; and means for laterally adjusting the position of said one of said front wheels relative to said frame;

at least one of said spray gun mounting means being secured to the mounting means for said wheel to move laterally with said wheel;

whereby, said one of said spray guns may be moved laterally relative to said frame and said other spray gun while remaining adjacent said laterally movable front wheel.

10. The device of claim 9 wherein two spray guns are mounted outboard of said laterally movable wheel relative to said frame.

11. The device of claim 9 wherein one of said spray guns is mounted outboard of each of said two front wheels.

12. The device of claim 9 wherein a first spray gun is mounted inboard of said laterally movable wheel and a second spray gun is mounted overboard of said laterally movable wheel.

13. A device for spraying lines on a pavement comprising:

a frame member;

a paint reservoir mounted on said frame for holding a supply of paint;

means mounted on said frame for pressurizing said paint;

two spaced apart and pivotally fixed front wheels secured to said frame on a common axis;

one of said front wheels mounted on an axle which is selectively movable laterally along said common axis relative to said frame;

a pivotable rear wheel secured to said frame;

a plurality of spray guns connected by conduit means to said pressurized paint;

means for removably mounting said spray guns closely adjacent said front wheels and selectively positionable along the vertical plane of said common axis;

at least one of said spray guns being mounted on said axle adjacent said laterally movable wheel; and means for selectively and independently manually activating said spray guns for applying paint to said pavement;

whereby said spray gun mounted adjacent said laterally movable wheel may also be moved laterally with said wheel.

14. The device of claim 13 wherein said spray guns can be removed from said device for hand held spraying.

* * * * *